US005775954A

United States Patent [19]

Kerckhof et al.

[11] Patent Number: 5,775,954

[45] Date of Patent: Jul. 7, 1998

[54] ELECTRICAL PLUG-IN CONNECTOR

[75] Inventors: Bart Kerckhof, Oostkamp, Belgium; Artur Wohlfart, Bad Durkheim, Germany; Joris Dobbelaere, Beernem, Belgium

[73] Assignee: Siemens Aktiengesellschaft, Munich, Germany

[21] Appl. No.: 657,410

[22] Filed: Jun. 3, 1996

[30] Foreign Application Priority Data

Jun. 2, 1995 [DE] Germany ..... 195 20 417.4

[51] Int. Cl.[6] ..... H01R 13/502

[52] U.S. Cl. ..... 439/701; 439/717

[58] Field of Search ..... 439/594, 595, 439/660, 682, 686, 701, 712–717, 752

[56] References Cited

U.S. PATENT DOCUMENTS 5,190,476 3/1993 Chaillot ..... 439/595

5,286,225 2/1994 Tsuji .

5,288,251 2/1994 Sumida ..... 439/701

5,551,896 9/1996 Hess et al. ..... 439/701

*Primary Examiner*—Khiem Nguyen

*Attorney, Agent, or Firm*—Herbert L. Lerner; Laurence A. Greenberg

[57] ABSTRACT

An electrical plug-in connector includes an encompassing enclosure having side walls defining an interior and having guides in the interior. Modular multipole contact enclosures for insertion in the interior, each have one-piece contact chambers being disposed next to each other in a row and being connected with each other and having integrated locking devices. Contact elements are to be inserted and locked in the contact chambers for connecting and combining one of the contact enclosures with at least one other of the contact enclosures to form a subassembly for insertion in the encompassing enclosure.

15 Claims, 3 Drawing Sheets

FIG 1
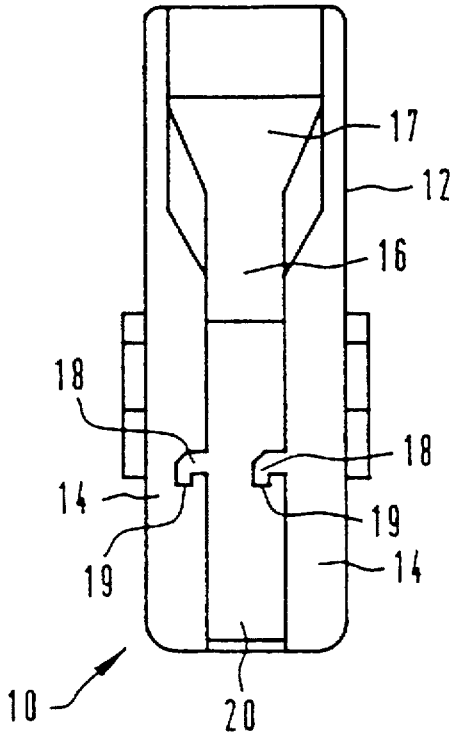
FIG 3
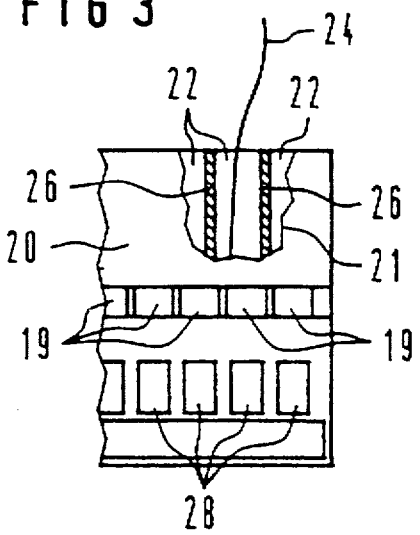
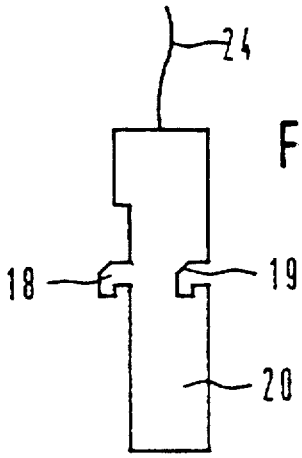
FIG 2

ELECTRICAL PLUG-IN CONNECTOR

BACKGROUND OF THE INVENTION

1. Field of the Invention

The invention relates to an electrical plug-in connector having an outside or encompassing enclosure with an interior or space that is bounded by side walls and provided with guides for receiving at least one multipole contact enclosure with contact chambers that are disposed next to each other for receiving lockingly insertable contact elements.

Published European Patent Application 0 210 468 discloses a plug-in connector with contact elements that are locked into a conductor terminal which is provided with insulation-piercing connecting device contact points for a ribbon cable inside insulating strip chambers that open only toward one flat side of the strip in such a way that a conductor can be pressed into contacting slots of the insulation piercing connecting device from an open side of the chambers. That makes it possible to dispose contact elements in multiple rows wherein the conductor is connected and therefore connection is established only after the contact elements have been inserted in the insulating strip. However, during installation it is possible for a contact element to fall out of the insulating strip, irrespective of whether or not it is connected with the conductor, in such a way that the assembly of the plug-in connectors requires special care and appropriate precautions to avoid possible errors.

German Published, Non-Prosecuted Patent Application DE 35 37 722 A1 discloses a plug-in connector of the initially mentioned type having an outside or encompassing enclosure into which a contact enclosure can be inserted which is provided with contact chambers that are disposed next to each other for receiving contact elements. In order to secure the position of the contact elements which are inserted into the contact chambers, the disclosed contact enclosures have an intermediate segment mounted on the associated outside or encompassing enclosure, onto which segment a locking edge is formed that protrudes into each contact chamber when the contact enclosure is inserted into the outside or encompassing enclosure, thus reaching behind one edge of the contact elements. If such contact enclosure is to be used to create a multi-row plug-in connector, the intermediate segments that are needed between each row require an amount of space that results in unfavorable dimensions of the plug-in connectors thus formed.

SUMMARY OF THE INVENTION

It is accordingly an object of the invention to provide an electrical plug-in connector, which overcomes the hereinafore-mentioned disadvantages of the heretofore-known devices of this general type and which keeps dimensions small while meeting requirements for sufficient insulation, easy installation or assembly and safe handling.

With the foregoing and other objects in view there is provided, in accordance with the invention, an electrical plug-in connector, comprising an encompassing enclosure having side walls defining an interior and having guides in the interior; modular multipole contact enclosures for insertion in the interior, the contact enclosures each having one-piece contact chambers being disposed next to each other in a row and being connected with each other and having integrated locking devices; and contact elements to be inserted and locked in the contact chambers for connecting and combining one of the contact enclosures with at least one other of the contact enclosures to form a subassembly for insertion in the encompassing enclosure.

In accordance with another feature of the invention, each contact enclosure has a rear wall and an end surface common to all of the associated contact chambers.

In accordance with a further feature of the invention, the contact chambers share a partitioning wall with the laterally adjacent contact chambers while each is provided with a window in its end surface.

In accordance with an added feature of the invention, the window in the end surface of each contact chamber serves as a locking device, in such a way that a retaining tab which is disposed on the associated contact element engages with the window and thus secures the contact element inside the contact chamber.

In accordance with an additional feature of the invention, the retaining tab is resilient and snaps onto the edge of the window where it is supported. Therefore, an embodiment of the invention makes it possible at any time to remove the corresponding contact element from the contact chamber by actuating the retaining tab which can be reached through the window.

In accordance with yet another feature of the invention, each contact enclosure has form-lockingly connected interlocking elements which serve to interlock it with additional contact enclosures. A form-locking connection is one which connects two elements together due to the shape of the elements themselves, as opposed to a force-locking connection, which locks the elements together by force external to the elements.

In accordance with yet a further feature of the invention, the interlocking elements are formed as integral hooks or recesses compatible therewith.

In accordance with yet an added feature of the invention, the recesses compatible with the hooks are respectively disposed on the end surface of the contact enclosures while the integrally formed hooks are respectively disposed on the rear wall of the contact enclosures that are constructed as individual modules.

In accordance with yet an additional feature of the invention, the contact enclosure is a twin module with the contact chambers being disposed in two rows, and the two rows are coupled together by a common rear wall which has no hooks.

In accordance with again another feature of the invention, the contact enclosure constructed as a twin module is provided on its two long side walls with respective end surfaces which have recesses that are compatible with the hooks, and the recesses reach channel-like through the end surface of each contact enclosure parallel to its longitudinal axis.

Accordingly, the channel-like recesses which are compatible with the hooks act as a keyway with which the spring-like hooks of the adjacent contact enclosure that is to be attached engage.

In accordance with again a further feature of the invention, the contact enclosure constructed as a twin module makes it possible to connect an individual module to either of its sides.

In accordance with a concomitant feature of the invention, each contact enclosure including individual and/or twin modules can be inserted into a corresponding outside or encompassing enclosure in a locking manner.

Other features which are considered as characteristic for the invention are set forth in the appended claims.

Although the invention is illustrated and described herein as embodied in an electrical plug-in connector, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 1 is a diagrammatic, side-elevational view of a plug-in connector with a contact enclosure according to the invention;

FIG. 2 is a side-elevational view of an individual contact enclosure according to FIG. 1;

FIG. 3 is a partially broken-away, plan view of part of an individual contact enclosure;

DESCRIPTION OF THE PREFERRED EMBODIMENTS

Figure 4:
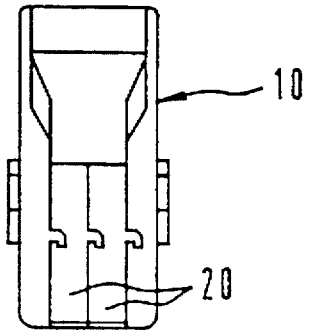
FIG. 4 is a side-elevational view of a plug-in connector with two individual contact enclosures.

Referring now to the figures of the drawings in detail and first, particularly, to FIG. 1 thereof, there is seen a plug-in connector 10 according to the invention having an outside or encompassing enclosure 12, in which an interior or chamber 16 is bounded by sidewalls 14 and provided with guides 18 for a contact enclosure 20 which is inserted therein by its longitudinal extension in such a way that only one side is shown.

The guides 18, on one hand, serve to keep the contact enclosure 20 in its specified position and, on the other hand, prevent confusion and incorrect connection as well as incorrect poling that may result as a consequence. For this reason, the guides 18 are formed on one side as protruding hooks 18 which engage with compatible recesses 19 in the contact enclosure 20 that on an opposite side is again provided with protruding hooks 18 which engage with compatible recesses 19 in the other sidewall 14 of the outside or encompassing enclosure 12.

The plug-in connectors 10 depicted in FIGS. 4 through 6 and 8 through 10 respectively illustrate a further function of the hooks 18 and the recesses 19, which is to ensure a form-locking connection of individual contact enclosures 20 to form a subassembly. This function is also the main concept behind the present invention. The contact enclosures 20 according to the present invention are complete with all the required details, in contrast to other plug-in connectors known in the art, the construction of which generally provides for a separation of individual functions and for which, as mentioned initially, there is no provision for complete enclosures to house and secure the contacts, but instead for strips and the like disposed inside the plug-in connector enclosure. Not only are individual contact chambers 22 disposed next to each other and solidly insulated from each other by partitioning walls, but leads 24 which are inserted in the contact enclosures 20 or the contact chambers 22 are secured in an integrated manner. This is accomplished by snap-on surfaces which work with retaining tabs provided on the contacts. The retaining tabs are connected to corresponding ends of the leads 24 which are inserted in the contact chamber 22. Snap-on surfaces of the contact chamber 20 according to the invention are formed as windows 28 which are shown in FIG. 3 and with which non-illustrated retaining tabs engage.

An open space or chamber 17 which serves as a cable compartment is disposed in the interior or chamber 16, above the contact enclosure 20 which is inserted in the outside or encompassing enclosure 12. Such a cable compartment accommodates the individual leads 24 that are run into the contact chambers 22 which are shown, for example, in a partially broken-away region 21 of FIG. 3, without impairing the handling of the respective contact enclosure 20. The contact chambers 22 extend over the entire height of the contact chamber and are respectively separated by sidewalls 26, in such a way that the leads 24, which are inserted therein and are provided with non-illustrated contact plugs or insulation piercing connecting devices, are adequately separated and insulated from each other.

Figure 5:
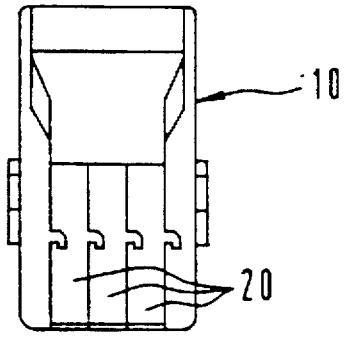
FIG. 5 is a side-elevational view of a plug-in connector with three individual contact enclosures.
Figure 6:
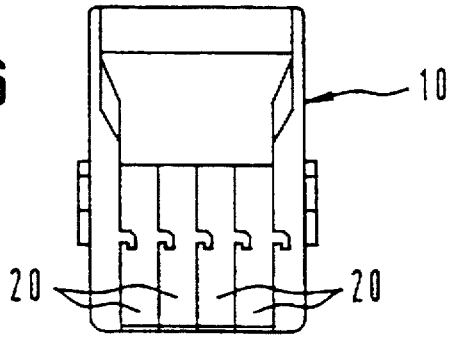
FIG. 6 is a side-elevational view of a plug-in connector with four individual contact enclosures.

FIGS. 4 through 6 respectively show side-elevational views of a plug-in connector. The only difference in this case as compared to FIG. 1 is that respective individual contact enclosures 20 are added, that is FIG. 4 provides for two individual contact enclosures 20, FIG. 5 provides for three individual contact enclosures 20 and finally FIG. 6 provides for four individual contact enclosures 20. Based on the form-locking connection of individual contact enclosures 20 according to the invention, the contact enclosures form an individual sub-assembly and thus substantially facilitate handling.

Figure 7:
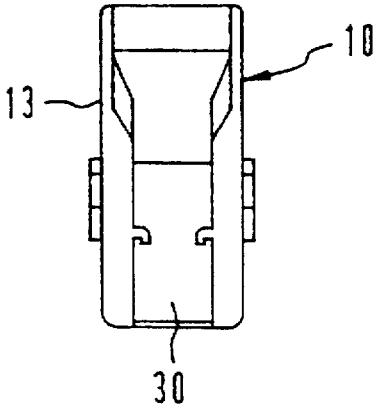
FIG. 7 is a side-elevational view of a plug-in connector with a twin contact enclosure.
Figure 9:
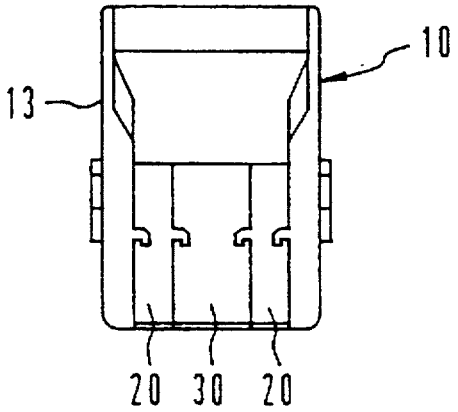
FIG. 9 is a side-elevational view of a plug-in connector with a twin contact enclosure and two individual contact enclosures.
Figure 8:
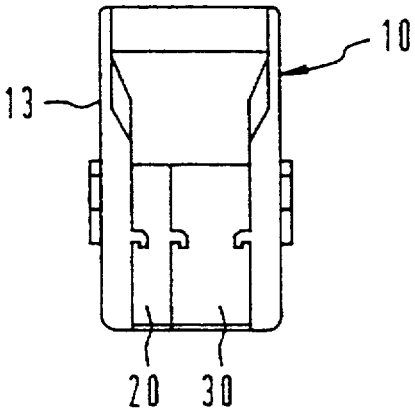
FIG. 8 is a side-elevational view of a plug-in connector with a twin contact enclosure and one individual contact enclosure.
Figure 10:
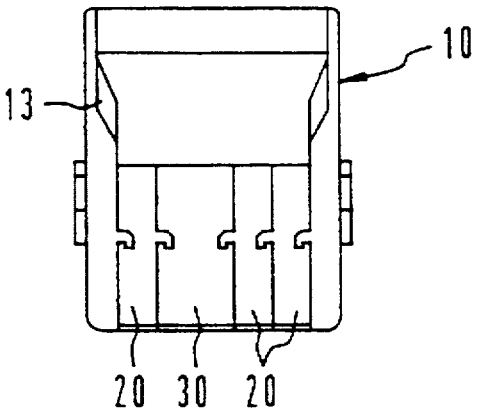
FIG. 10 is a side-elevational view of a plug-in connector with a twin contact enclosure and three individual contact enclosures.

FIGS. 7 and 8 also depict plug-in connectors which differ from the previously described plug-in connectors 10 in that they are provided with a differently constructed outside or encompassing enclosure 13 with contact enclosures differing from the contact enclosures 20. Specifically, a differently constructed enclosure 30 which is referred to as a twin enclosure is provided. In contrast to the individual contact enclosures 20, the twin enclosure 30 has a non-illustrated double-row configuration of contact chambers 22, the geometry of which is identical to that of the contact enclosures 20. Accordingly, the contact chambers 22 of a first row respectively have a rear wall in common with the contact chambers 22 of a second row.

In contrast to the individual contact chambers shown in FIG. 1 through 6, an additional difference is evident in FIGS. 7 through 10 in which the enclosures 30 are not provided with hooks 18 to serve as securing and guiding devices but rather with recesses 19 that are compatible with the hooks and are disposed on two long sides. Accordingly, the construction of the outside or encompassing enclosure 13 which receives the twin enclosures 30 differs in that the hooks 18 are provided on the inside of the two side walls, with the hooks form-lockingly connecting with the recesses formed in the twin enclosure 30.

We claim:

1. An electrical plug-in connector, comprising:

an encompassing enclosure having side walls defining an interior and having guides in said interior;

at least one modular multipole contact enclosure for insertion in said interior, said at least one contact enclosure having one-piece contact chambers being disposed next to each other in a row and being connected with each other and having integrated locking devices;

contact elements to be inserted and locked in said contact chambers; and said at least one contact enclosure and one of said side walls having integral hooks, said at least one contact enclosure and another of said side walls having recesses formed therein compatible with said integral hooks, said at least one contact enclosure forming a form-locking connection with each of said side walls of said encompassing enclosure via said hooks and recesses formed on opposite side walls of said at least one contact enclosure and said side walls.

2. The plug-in connector according to claim 1, wherein said at least one contact enclosure has a rear wall and an end surface being common to all of said associated contact chambers and each of said contact chambers has a partitioning wall in common with laterally adjoining contact chambers and has a window in said end surface.

3. The plug-in connector according to claim 2, wherein said window is an integrated locking device, and an associated contact element has a retaining tab disposed thereon for engaging said window and securing said contact element within said contact chamber.

4. The plug-in connector according to claim 3, wherein said retaining tab is resilient and is lockingly supported on an edge at said window.

5. The plug-in connector according to claim 4, wherein a corresponding contact element is removed by actuating said retaining tab through said window in said end surface.

6. The plug-in connector according to claim 1, wherein said at least one contact enclosure having a hook and a recess is one of a plurality of contact enclosures, said plurality of contact enclosures being form-lockingly connected to each other.

7. The plug-in connector according to claim 1, wherein said recesses being compatible with said hooks are disposed on an end surface of said at least one contact enclosure.

8. The plug-in connector according to claim 7, wherein said integrally shaped hooks are disposed on a rear wall of said at least one contact enclosure being constructed as individual modules.

9. The plug-in connector according to claim 1, wherein said at least one contact enclosure is a twin module having contact chambers disposed in two rows, said two rows being connected to each other by a common rear wall having none of said hooks.

10. The plug-in connector according to claim 9, wherein said at least one contact enclosure constructed as a twin module has two long sides with a respective end surface in which said recesses being compatible with said hooks are formed.

11. The plug-in connector according to claim 10, wherein said recesses in said end surface of said at least one contact enclosure reach through said at least one contact enclosure parallel to its longitudinal axis like a channel.

12. The plug-in connector according to claim 9, wherein said at least one contact enclosure constructed as a twin module is to be connected with an individual module on either side.

13. The plug-in connector according to claim 1, wherein said at least one contact enclosure including said individual modules is to be inserted in a corresponding encompassing enclosure and interlocked therewith.

14. The plug-in connector according to claim 9, wherein said at least one contact enclosure including said twin modules is to be inserted in a corresponding encompassing enclosure and interlocked therewith.

15. The plug-in connector according to claim 9, wherein said at least one contact enclosure including said individual and twin modules is to be inserted in a corresponding encompassing enclosure and interlocked therewith.

* * * * *